US011384679B2

(12) United States Patent
Matsumoto et al.

(10) Patent No.: US 11,384,679 B2
(45) Date of Patent: Jul. 12, 2022

(54) EXHAUST DEVICE AND STRADDLE-TYPE VEHICLE

(71) Applicant: SUZUKI MOTOR CORPORATION, Hamamatsu (JP)

(72) Inventors: Akio Matsumoto, Hamamatsu (JP); Yasuhito Saiki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 262 days.

(21) Appl. No.: 16/882,256

(22) Filed: May 22, 2020

(65) Prior Publication Data

US 2020/0378296 A1 Dec. 3, 2020

(30) Foreign Application Priority Data

May 28, 2019 (JP) ..... JP2019-099496

(51) Int. Cl.
*F01N 13/18* (2010.01)
*F01N 13/14* (2010.01)

(52) U.S. Cl.
CPC ..... *F01N 13/1855* (2013.01); *F01N 13/14* (2013.01); *F01N 13/1888* (2013.01); *F01N 13/1805* (2013.01); *F01N 2450/18* (2013.01); *F01N 2450/24* (2013.01); *F01N 2530/18* (2013.01)

(58) Field of Classification Search
CPC .. F01N 13/1855; F01N 13/14; F01N 13/1888; F01N 13/1805; F01N 2450/18; F01N 1/00; F01N 13/185; F01N 2260/20; F01N 13/082
USPC ..... 181/227, 272, 282
See application file for complete search history.

(56) References Cited

U.S. PATENT DOCUMENTS 4,354,573 A 10/1982 Tabata et al.
6,438,949 B1 * 8/2002 Nozaki ..... F01N 13/14 60/272
6,499,561 B1 * 12/2002 Yasuda ..... F01N 13/08 181/227

(Continued)

FOREIGN PATENT DOCUMENTS

EP 1911945 A1 4/2008
JP 2009-108824 A 5/2009
JP 2017-129077 A 7/2017

OTHER PUBLICATIONS

German Office Action dated May 19, 2022, issued to German Application No. 102020114406.7.

*Primary Examiner* — Tom P Duong
(74) *Attorney, Agent, or Firm* — Stein IP, LLC

(57) ABSTRACT

An exhaust device in which a muffler is disposed on a side of a straddle-type vehicle includes the muffler including a tail pipe configured to discharge exhaust gas and protruding rearward, a tail cover covering a periphery of the tail pipe behind the muffler, and a protector for heat shield interposed between the muffler and the tail cover. Inner sides of the tail cover and the protector in a vehicle width direction are configured to be fixed to each other by a fastening member. An elastic locking portion is formed on an outer side of one of the tail cover and the protector in the vehicle width direction, and a holding portion configured to hold the elastic locking portion is formed on an outer side of another of the tail cover and the protector in the vehicle width direction.

10 Claims, 12 Drawing Sheets

(56) References Cited

U.S. PATENT DOCUMENTS

| | | | | |
|---|---|---|---|---|
| 7,007,720 | B1 | 3/2006 | Chase et al. | |
| 7,032,702 | B2 * | 4/2006 | Rinklin | F01N 13/1805 181/227 |
| 7,664,092 | B2 * | 2/2010 | Birdwell | H04L 65/607 370/465 |
| 7,946,380 | B2 * | 5/2011 | Yamamoto | F01N 13/14 181/227 |
| 7,997,383 | B2 * | 8/2011 | Sakurai | F01N 13/08 181/227 |
| 8,695,754 | B2 * | 4/2014 | Iiyama | F01N 13/082 181/227 |
| 2005/0023076 | A1 * | 2/2005 | Huff | F01N 13/1888 181/246 |
| 2009/0120716 | A1 | 5/2009 | Yamamoto et al. | 181/205 |
| 2010/0243371 | A1 * | 9/2010 | Inoue | F01N 13/082 181/227 |
| 2012/0267190 | A1 * | 10/2012 | Iiyama | F01N 13/082 181/227 |
| 2014/0090924 | A1 * | 4/2014 | Uzawa | F01N 1/089 181/227 |

* cited by examiner

EXHAUST DEVICE AND STRADDLE-TYPE VEHICLE

CROSS-REFERENCE TO RELATED APPLICATIONS

The disclosure of Japanese Patent Application No. 2019-099496 filed on May 28, 2019, including specification, drawings and claims is incorporated herein by reference in its entirety.

BACKGROUND

The present invention relates to an exhaust device and a straddle-type vehicle.

As an exhaust device for a straddle-type vehicle, there has been known an exhaust device in which an end cap is attached to a rear portion of a muffler via a heat shield cap (see, for example, Patent Literature 1). In the exhaust device described in Patent Literature 1, the heat shield cap is screwed to the rear portion of the muffler with a bolt, and the end cap is screwed to a rear portion of the heat shield cap with a bolt. Since the heat shield cap suppresses heat from the muffler being transferred to the end cap, the end cap can be molded with a resin having high moldability. Therefore, a design property of the end cap at the rear portion of the muffler, which is a heat source, can be improved.

Patent Literature 1: JP-A-2009-108824

SUMMARY

According to an aspect of the present invention, there is provided an exhaust device in which a muffler is disposed on a side of a straddle-type vehicle, the exhaust device including:

the muffler including a tail pipe configured to discharge exhaust gas and protruding rearward;

a tail cover covering a periphery of the tail pipe behind the muffler; and a protector for heat shield interposed between the muffler and the tail cover, wherein inner sides of the tail cover and the protector in a vehicle width direction are configured to be fixed to each other by a fastening member, and an elastic locking portion is formed on an outer side of one of the tail cover and the protector in the vehicle width direction, and a holding portion configured to hold the elastic locking portion is formed on an outer side of another of the tail cover and the protector in the vehicle width direction.

DETAILED DESCRIPTION OF EXEMPLIFIED EMBODIMENT

In recent years, as an exhaust device for a straddle-type vehicle, there is a demand for a design in which a fastening member such as a bolt is not seen from the outside, but a head portion of the bolt is exposed from the end cap in the exhaust device described in Patent Literature 1. Although a structure in which a fastening member such as a bolt is hidden in the end cap is also conceivable, it is difficult to fasten the fastening member with a fastening tool or the like, and a fastening work is troublesome.

The present invention has been made in view of the above circumstances, and an object thereof is to provide an exhaust device and a straddle-type vehicle that can reduce work burden when the exhaust device is assembled without impairing appearance of the exhaust device.

In an exhaust device according to an aspect of the present invention, a tail cover is attached to a muffler, which is disposed on a side of a straddle-type vehicle, via a protector. In this case, inner sides of the tail cover and the protector in a vehicle width direction are fixed by a fastening member, and outer sides of the tail cover and the protector in the vehicle width direction are fixed by elastic locking of an elastic locking portion formed on one of the tail cover and the protector and a holding portion formed on another of the tail cover and the protector. When the straddle-type vehicle is viewed from the side, since the fastening member is positioned in a blind spot on an inner side in the vehicle width direction, appearance of the exhaust device is not impaired by the fastening member. In addition, work burden on a worker is reduced and an assembly property is improved as much as the numbers of fastening portions by the fastening members is reduced. As described above, by combining the fastening of the fastening member and the elastic locking of the elastic locking portion and the holding portion, the work burden when the exhaust device is assembled can be reduced without impairing the appearance of the exhaust device.

Figure 1:
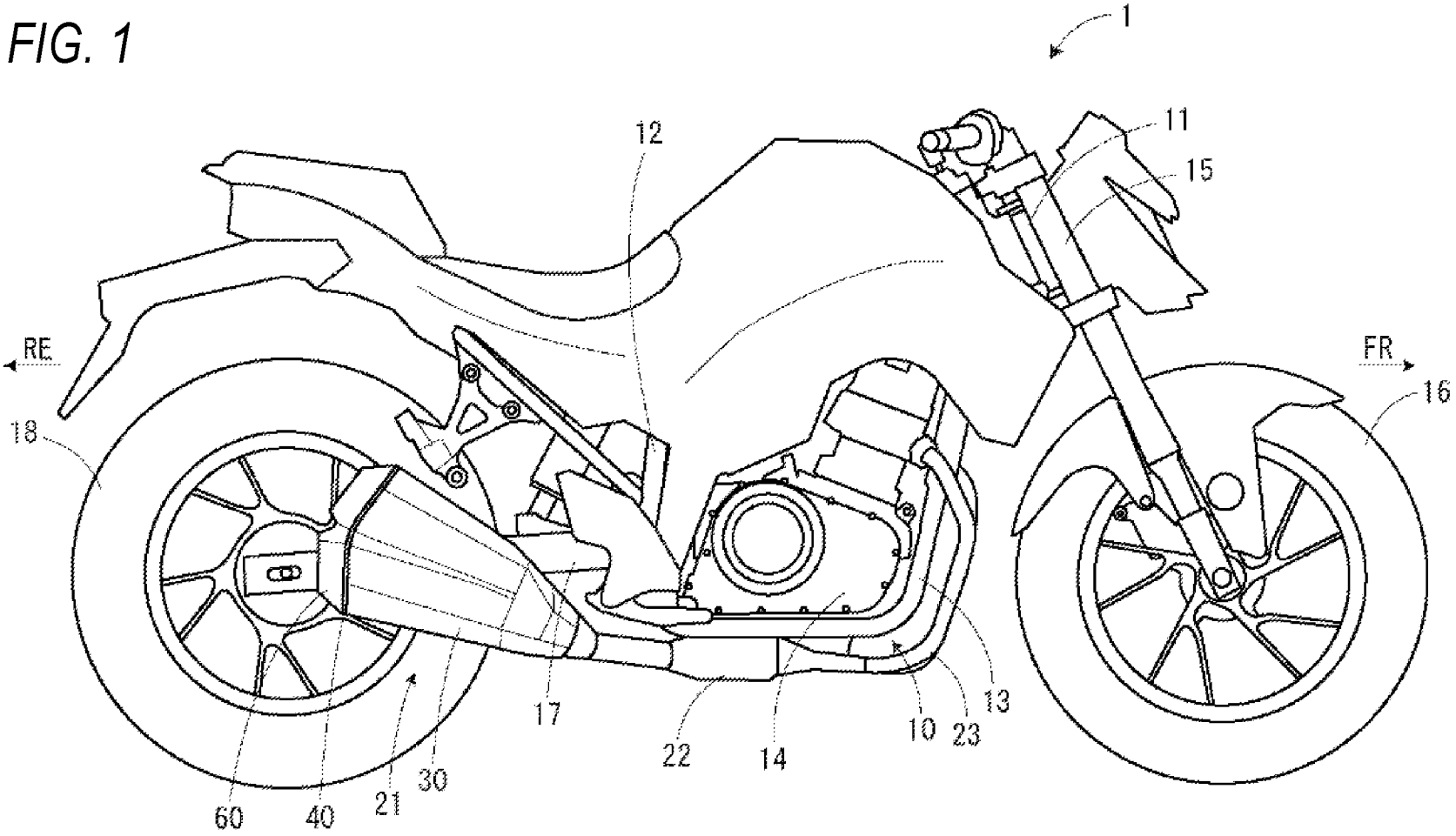
FIG. 1 is a side view of a motorcycle of an embodiment.

Hereinafter, an embodiment will be described in detail with reference to the accompanying drawings. Here, an example in which an exhaust device of the present embodiment is applied to a motorcycle as a straddle-type vehicle will be described, but an application object is not limited thereto. For example, the exhaust device may be applied to another straddle-type vehicle such as a buggy type motor tricycle. In addition, in the following drawings, a front side of a vehicle body is indicated by an arrow FR, a rear side of the vehicle body is indicated by an arrow RE, a left side of the vehicle body is indicated by an arrow L, and a right side of the vehicle body is indicated by an arrow R, respectively. FIG. 1 is a schematic view of a straddle-type vehicle of the present embodiment.

As shown in FIG. 1, a motorcycle 1 is configured by mounting various components such as an engine 14 and an electrical system on a cradle-type vehicle body frame 10. The vehicle body frame 10 includes a main tube 12 that extends rearward from a head pipe 11 and then bends downward, and a down tube 13 that extends downward from the head pipe 11 and bends rearward. A rear side of the engine 14 is supported by the main tube 12, and a front side and a lower side of the engine 14 are supported by the down tube 13. By supporting the engine 14 on the vehicle body frame 10, rigidity of the entire vehicle body of the motorcycle 1 is ensured.

A pair of left and right front forks 15 are supported on the head pipe 11 via a steering shaft (not shown) so as to be steerable, and a front wheel 16 is rotatably supported on a lower portion of the pair of left and right front forks 15. A swing arm 17 is swingably supported on a rear side of the main tube 12, and a rear wheel 18 is rotatably supported on a rear end side of the swing arm 17. The engine 14 is connected to the rear wheel 18 via a speed reduction mechanism, and power from the engine 14 is transmitted to the rear wheel 18 via the speed reduction mechanism. An exhaust device 21 that discharges exhaust gas from the engine 14 is disposed on a side of the rear wheel 18.

The exhaust device 21 is connected to an exhaust pipe 23 extending rearward from a front surface of the engine 14 via a catalyst case 22. The exhaust gas from the engine 14 is purified in the catalyst case 22 and discharged to the outside through a muffler 30 of the exhaust device 21. A tail cover 60 that covers tail pipes 31 (see FIG. 2) of the muffler 30 is provided behind the muffler 30. Since a design property is required for the tail cover 60, the tail cover 60 is formed of a resin having high moldability that can be plated, but the resin having such properties has a low heat resistance temperature. Since the muffler 30 reaches a high temperature by the exhaust gas, the tail cover 60 cannot be directly fixed to a rear portion of the muffler 30.

Therefore, a protector 40 having high heat resistance is usually interposed between the muffler 30 and the tail cover 60. Since the heat transferred from the muffler 30 to the tail cover 60 is suppressed by the protector 40, the tail cover 60 having the high design property can be provided on a rear side of the high-temperature muffler 30. However, when the tail cover 60 is fixed to the protector 40 by a fastening member such as a bolt, the fastening member exposed to the rear or a side of the muffler 30 is conspicuous, and appearance of the exhaust device 21 is impaired. In addition, a fastening work of the fastening member is troublesome for a worker, and an assembly property of the protector 40 and the tail cover 60 is deteriorated.

Therefore, in the present embodiment, when the muffler 30 is disposed on a side of the motorcycle 1, focusing on a point that an inner side of the muffler 30 in a vehicle width direction becomes inconspicuous, a fixing method of inner sides of the protector 40 and the tail cover 60 in the vehicle width direction and a fixing method of outer sides of the protector 40 and the tail cover 60 in the vehicle width direction are changed. The inner sides of the protector 40 and the tail cover 60 in the vehicle width direction are fixed by the fastening member, and the outer sides of the 40 and the tail cover 60 in the vehicle width direction are fixed by a snap fit, so that the number of fastening portions of the fastening members is reduced without making the fastening member conspicuous. Accordingly, the assembly property of the protector 40 and the tail cover 60 can be improved without impairing the appearance of the exhaust device 21.

Figure 2:
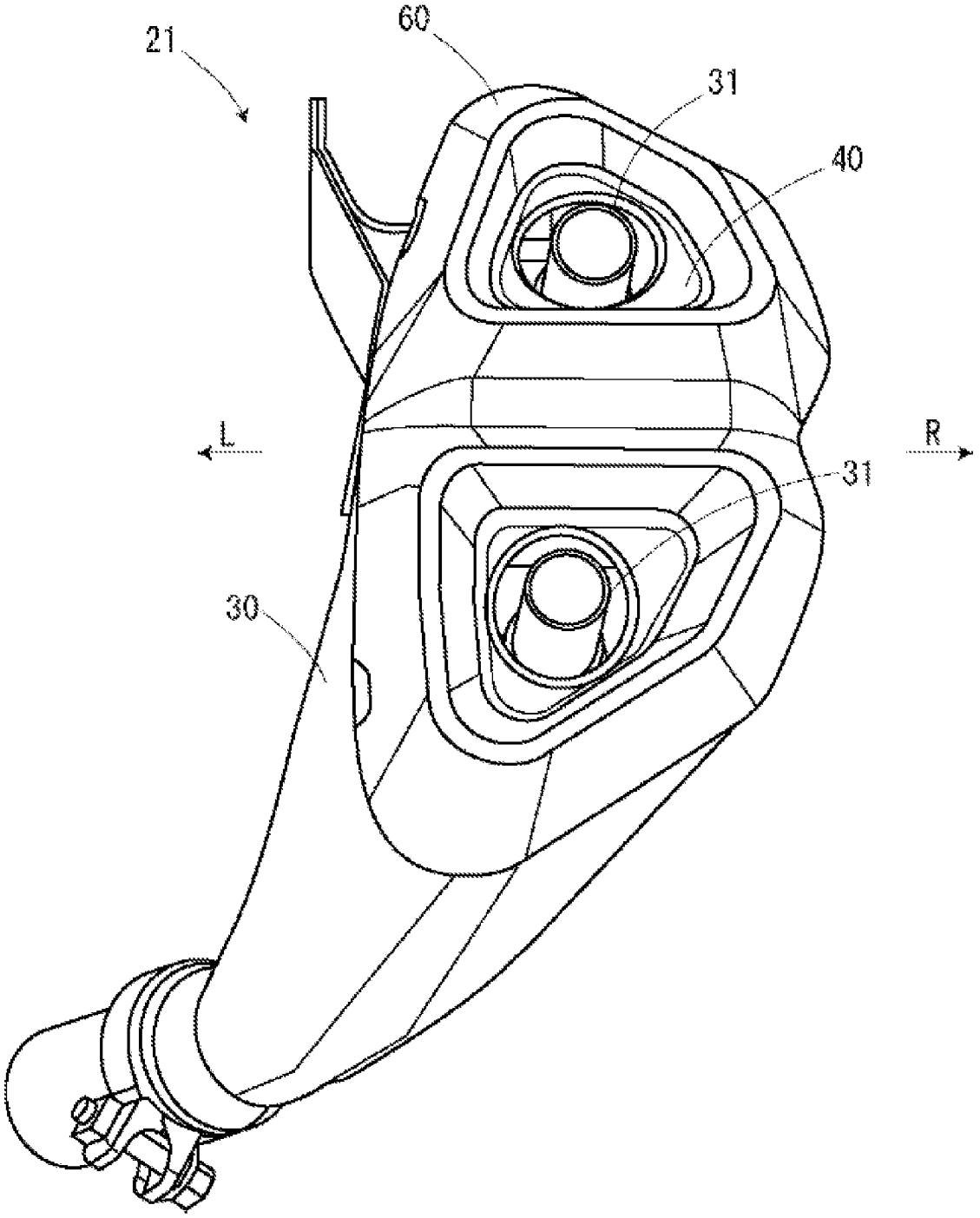
FIG. 2 is a rear view of an exhaust device of the embodiment.
Figure 3:
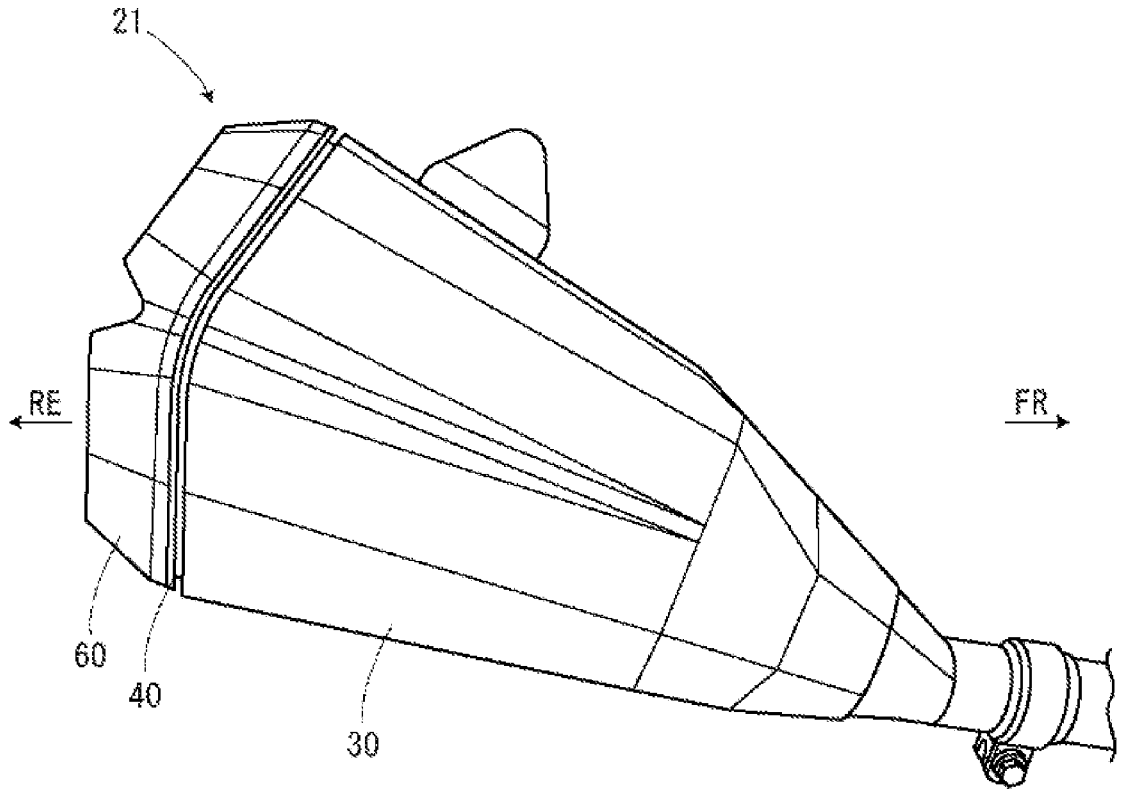
FIG. 3 is a right side view of the exhaust device of the embodiment.
Figure 4:
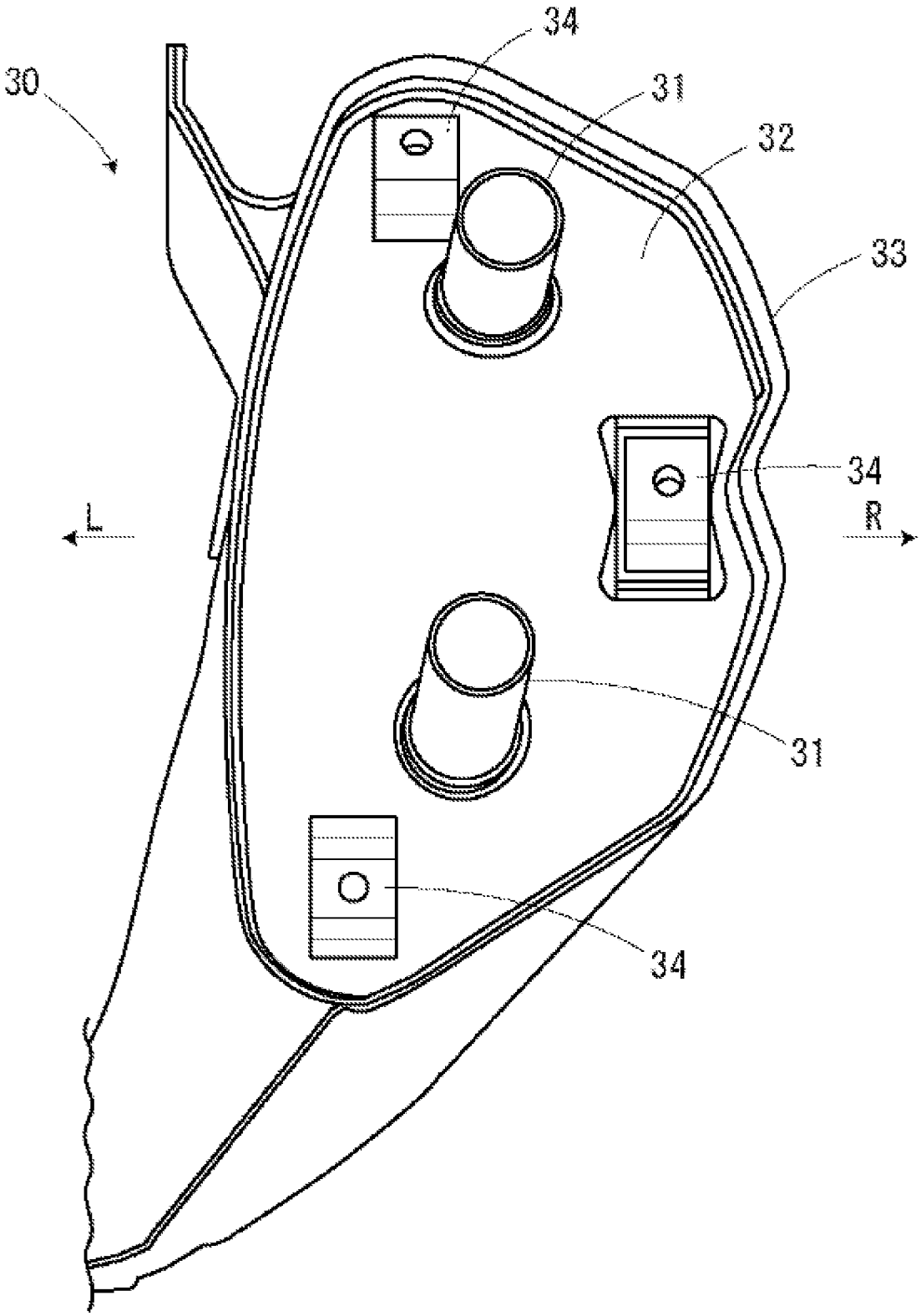
FIG. 4 is a rear view of a muffler of the embodiment.
Figure 5A:
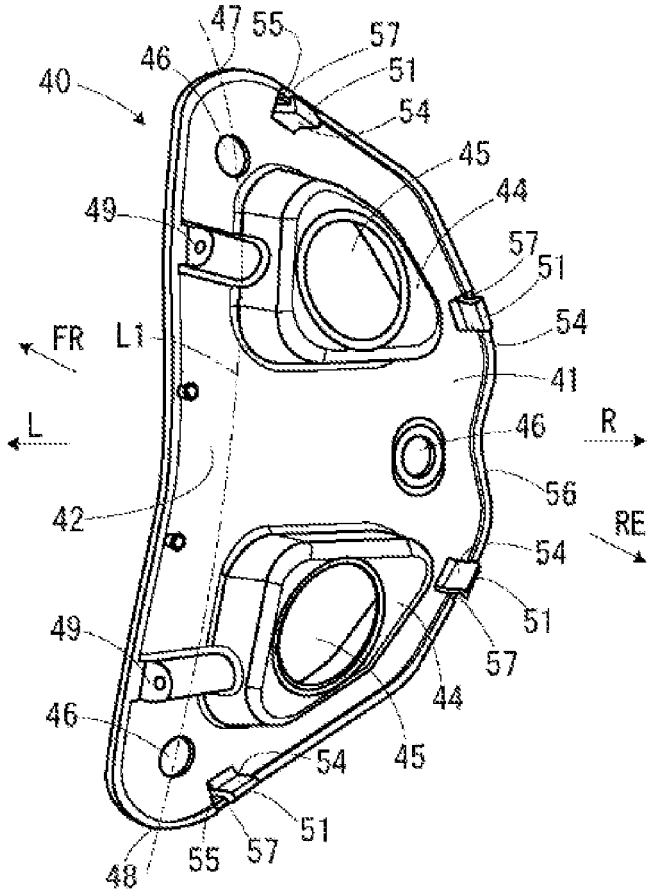
FIG. 5A is a perspective view of a protector of the embodiment as viewed from the rear.
Figure 5B:
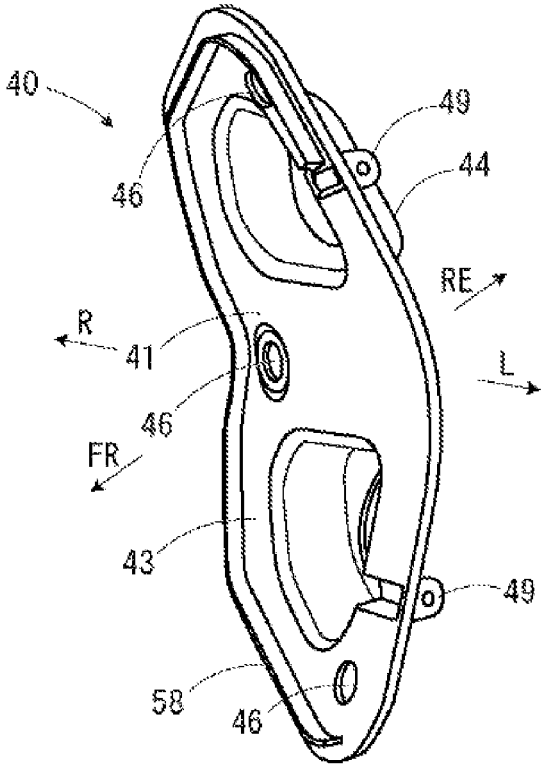
FIG. 5B is a perspective view of the protector of the embodiment as viewed from the front.
Figure 6A:
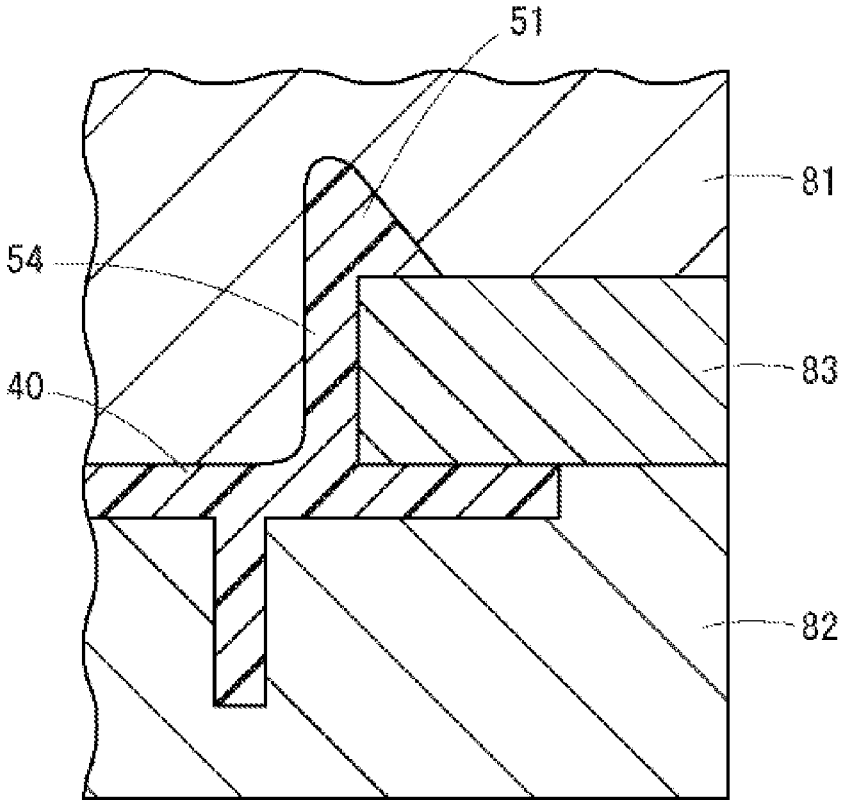
FIG. 6A is a schematic view of a mold of a comparative example.
Figure 6B:
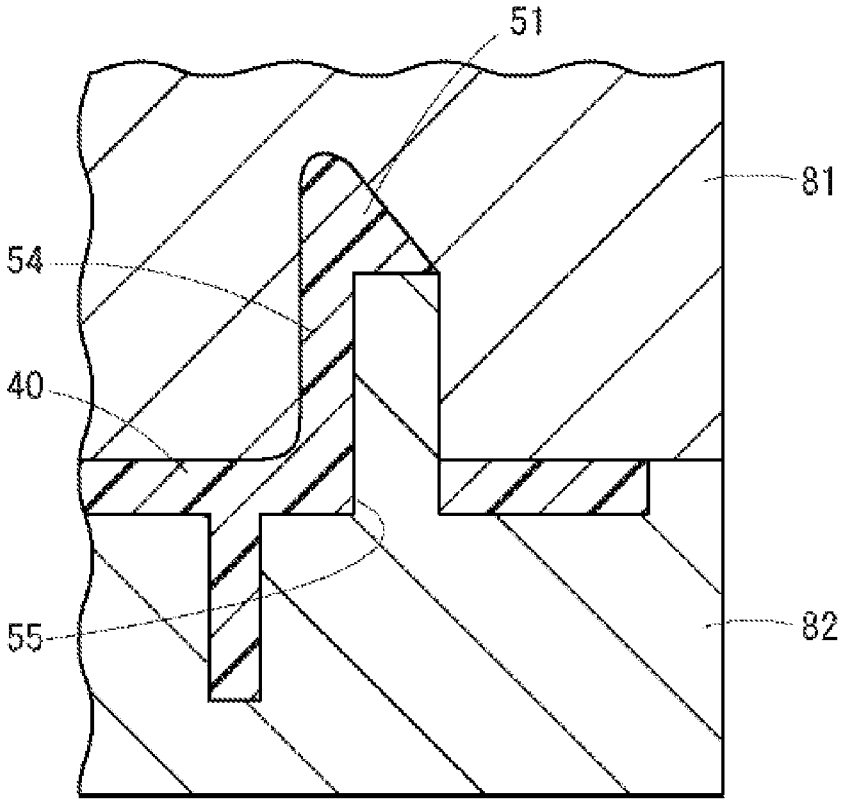
FIG. 6B is a schematic view of a mold of the embodiment.
Figure 7A:
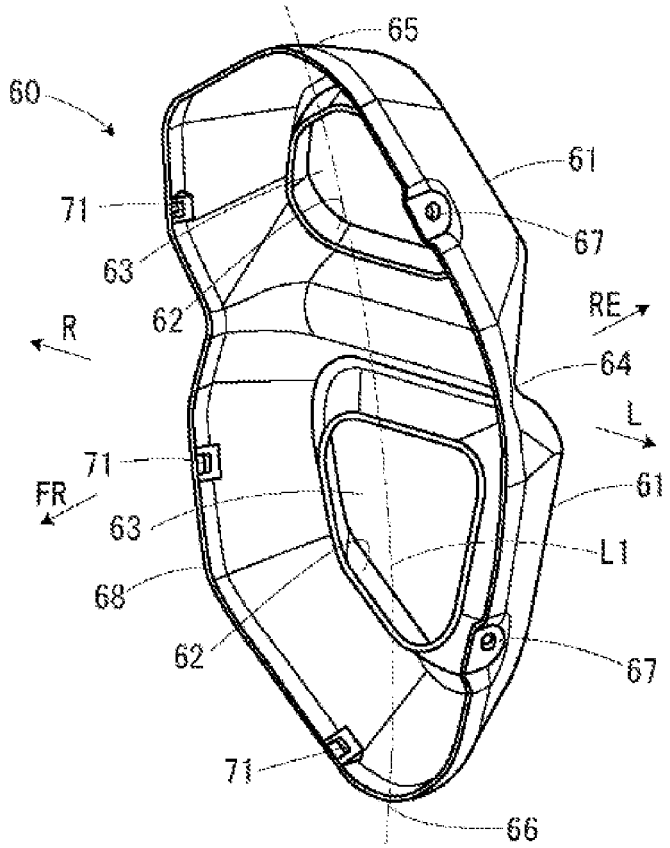
FIG. 7A is a perspective view of a tail cover of the embodiment as viewed from the front.
Figure 7B:
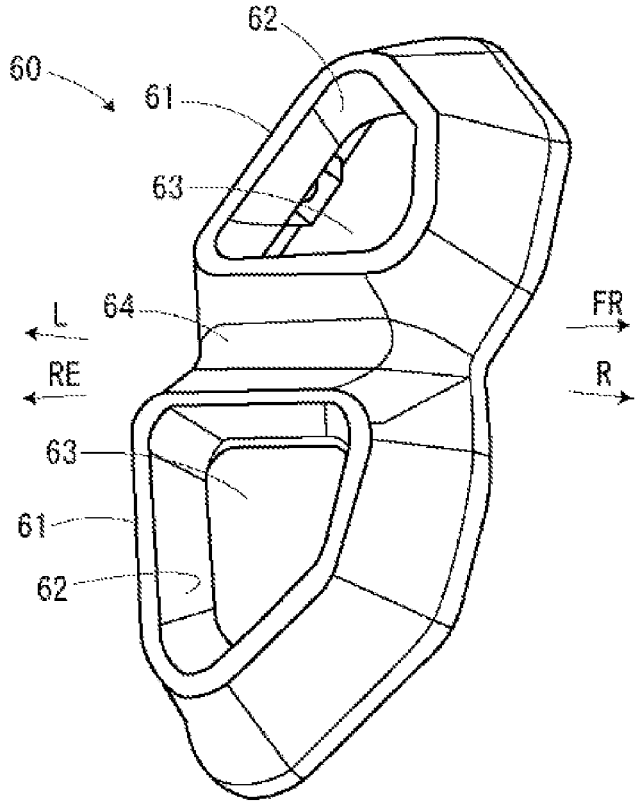
FIG. 7B is a perspective view of the tail cover of the embodiment as viewed from the rear.

Hereinafter, the exhaust device of the present embodiment will be described with reference to FIGS. 2 to 7. FIG. 2 is a perspective view of an exhaust device of the present embodiment. FIG. 3 is a right side view of the exhaust device of the present embodiment. FIG. 4 is a perspective view of a rear portion of the muffler of the present embodiment. FIG. 5A is a perspective view of the protector of the present embodiment as viewed from the rear, and FIG. 5B is a perspective view of the protector of the present embodiment as viewed from the front. FIG. 6A is a schematic view of a mold of a comparative example, and FIG. 6B is a schematic view of a mold of the present embodiment. FIG. 7A is a perspective view of the tail cover of the present embodiment as viewed from the front, and FIG. 7B is a perspective view of the tail cover of the present embodiment as viewed from the rear.

As shown in FIGS. 2 and 3, in the exhaust device 21 of the present embodiment, the tail cover 60 is attached to the rear portion of the muffler 30 via the protector 40 for heat shield. The pair of upper and lower tail pipes 31 protrude rearward from the rear portion of the muffler 30, and a periphery of each tail pipe 31 is covered with the tail cover 60 to suppress deterioration of appearance thereof. The muffler 30 has a diameter that increases toward the rear of the vehicle, and is curved so that a center of the rear portion of the muffler 30 swells rearward as viewed from a side. The protector 40 and the tail cover 60 are also curved along a rear shape of the muffler 30, and the entire device is formed with a design having a sense of unity.

As shown in FIG. 4, the pair of upper and lower tail pipes 31 that discharge the exhaust gas muffled by the muffler 30 to the atmosphere protrude from a rear surface 32 of the muffler 30. Three brackets 34 for attaching the protector 40 (see FIG. 2) are provided on the rear surface 32 of the muffler 30 so as to surround the pair of upper and lower tail pipes 31. Each bracket 34 is formed in a hat shape as viewed in a cross section, and the protector 40 is attached to the bracket 34, so that the protector 40 is separated from the rear surface 32 of the muffler 30. An outer edge portion 33 of the muffler 30 extends rearward of the vehicle from the rear surface 32 of the muffler 30, and an extension amount of the outer edge portion 33 is smaller than a protrusion amount of the bracket 34.

As shown in FIGS. 5A and 5B, the protector 40 is formed of a resin material having a high heat resistance temperature. As the resin material, for example, a nylon resin may be used, or a fiber reinforced resin using the nylon resin as a base resin may be used. As the fiber reinforced resin, a glass fiber reinforced resin (PA6-GF30) in which 30% glass fiber is blended with the polyamide 6 may be used. Incidentally, the resin material of the protector 40 is not particularly limited as long as it is a resin material that can suppress the heat transferred from the muffler 30 (see FIG. 2) to the tail cover 60 (see FIG. 2) via the protector 40 to the heat resistant temperature of the tail cover 60 or lower.

The protector 40 has a plate-like portion 41 slightly curved along the rear portion of the muffler 30. The plate-like portion 41 is formed to have substantially the same outer shape as the rear surface 32 (see FIG. 4) of the muffler 30 as viewed from a rear. Portions in the plate-like portion 41 corresponding to the pair of upper and lower tail pipes 31 bulge rearward, and openings 45 through which the tail pipes 31 are inserted are formed at centers of bulging portions 44, respectively. The periphery of the tail pipe 31 is covered by the bulging portion 44 of the protector 40, and only a rear end portion of the tail pipe 31 protrudes rearward from the bulging portion 44 (see FIG. 2). In addition, three through holes 46 are formed at portions in the plate-like portion 41 corresponding to the three brackets 34 (see FIG. 4).

In the protector 40, a left side of a straight line L1 passing through the uppermost portion 47 and the lowermost portion 48 is a blind spot area that cannot be seen from the side (right side) of the vehicle, and a right side of the straight line L1 is an exposed area that can be seen from the side of the vehicle. That is, the inner side of the protector 40 in the vehicle width direction is the blind spot area, and the outer side of the protector 40 in the vehicle width direction is the exposed area. A pair of boss portions 49 to which the tail cover 60 is screwed are formed on the inner side of the protector 40 in the vehicle width direction, and four claw portions 51 to which the tail cover 60 is fixed by the snap fits are formed on the outer side of the protector 40 in the vehicle width direction.

The pair of boss portions 49 are formed to bulge rearward from a rear surface 42 of the plate-like portion 41, and extend from a vicinity of an outer edge portion of the plate-like portion 41 on the inner side in the vehicle width direction toward the bulging portions 44. Each of the boss portions 49 is formed with a screw hole capable of screwing the tail cover 60 from the inner side in the vehicle width direction. The four claw portions 51 are respectively formed on tip end sides of elastic arms 54 erected on the rear surface 42 of the plate-like portion 41. Each of the claw portions 51 protrudes in a triangular shape as viewed in the cross section toward the outside of the plate-like portion 41, and is a hook that is held by a holding portion 71 (see FIG. 10) having an inverted triangular shape in a cross section of the tail cover 60, which will be described later. Incidentally, the detailed shape of the claw portion 51 will be described later.

In the plate-like portion 41, a through hole 55 (see FIG. 10) is formed on a projection surface obtained by projecting the claw portion 51 onto the rear surface 42 of the plate-like portion 41. This prevents the claw portion 51 from being undercut when the protector 40 is released from a mold. That is, in a case where the through hole 55 is not formed on the protector 40, as shown in FIG. 6A, a slide mold 83 is required in addition to an upper mold 81 and a lower mold 82 in order to form the claw portion 51 on the protector 40. On the other hand, in a case where the through hole 55 is formed on the protector 40, as shown in FIG. 6B, the slide mold 83 is not required to form the claw portion 51 on the protector 40. Incidentally, the through hole 55 also functions as a heat discharge hole.

Returning to FIGS. 5A and 5B, a rear peripheral wall portion 56 protrudes rearward from the outer edge portion of the plate-like portion 41 on the rear surface 42 of the plate-like portion 41. The rear peripheral wall portion 56 is formed so as to be able to abut an outer edge portion 68 of the tail cover 60 (see FIG. 7A) over substantially the entire circumference. Recessed portions 57 are formed on the rear peripheral wall 56 at positions facing the elastic arms 54, respectively. When the outer edge portion 68 of the tail cover 60 abuts against the rear peripheral wall portion 56, a through hole is formed in mating surfaces of the protector 40 and the tail cover 60 (see FIG. 10). The through hole functions as a working hole for inserting a tip end of a tool such as a flathead screwdriver in order to release the fixing of the protector 40 and the tail cover 60. The through hole also functions as the heat discharge hole.

On the front surface 43 of the plate-like portion 41, a front peripheral wall portion 58 protrudes forward from the vicinity of the outer edge portion of the plate-like portion 41. The front peripheral wall portion 58 is formed along an inner peripheral surface of the outer edge portion 33 (see FIG. 4) of the muffler 30. As will be described in detail later, since a tip end side of the front peripheral wall portion 58 is accommodated inside the outer edge portion 33 of the muffler 30, the front peripheral wall portion 58 functions as a hiding member for improving the design property by covering a gap C2 between the protector 40 and the muffler 30 (see FIG. 9A). In addition, the front peripheral wall portion 58 is formed along the inner peripheral surface of the outer edge portion 33 of the muffler 30 excluding an inconspicuous portion in the inner side in the vehicle width direction. As a result, a heat discharge property can be improved without impairing the appearance of the muffler 30.

As shown in FIGS. 7A and 7B, the tail cover 60 is formed of a resin material that has the high moldability and can be plated. Acrylonitrile butadiene styrene (ABS) may be used as the resin material, for example. Since the protector 40 (see FIGS. 5A and 5B) having the high heat resistance temperature is interposed between the tail cover 60 and the muffler 30 (see FIG. 4), the tail cover 60 can be formed of the ABS resin having a low heat resistance temperature. Since the tail cover 60 is formed of the ABS resin, a surface of the tail cover 60 can be given a metallic luster by metal plating while ensuring a degree of freedom in design.

The tail cover 60 has a pair of annular bulging portions 61 bulging rearward so as to surround the pair of upper and lower tail pipes 31. An inner edge portion 62 of each annular bulging portion 61 is folded forward, and an inner side of the inner edge portion 62 is an opening 63 through which the rear end portion of the tail pipe 31 passes. Since each of the annular bulging portions 61 is bulged rearward from the rear end portion of the corresponding tail pipe 31, the periphery of the tail pipe 31 is entirely covered by the annular bulging portion 61. In addition, the inner edge portion 62 of the tail cover 60 extends to a vicinity of the bulging portion 44 (see FIG. 5A) of the protector 40. A V-shaped depression 64 that divides the tail cover 60 into upper and lower portions is formed between the pair of annular bulging portions 61.

The tail cover 60 is formed to have substantially the same outer shape as the protector 40 as viewed from the rear. Therefore, in the tail cover 60, an inner side in the vehicle width direction on a left side of a straight line L1 passing through the uppermost portion 65 and the lowermost portion 66 is a blind spot area that cannot been seen from the side (right side) of the vehicle, and an outer side in the vehicle width direction on a right side of the straight line L1 is an exposed area that can be seen from the side of the vehicle. A pair of fastening holes 67 for screwing the tail cover 60 with respect to the protector 40 are formed on the inner side of the tail cover 60 in the vehicle width direction, and the four holding portions 71 fixed to the protector 40 by the snap fits are formed on the outer side of the tail cover 60 in the vehicle width direction.

The pair of fastening holes 67 are formed at positions of the tail cover 60 corresponding to the boss portions 49 of the protector 40. The four holding portions 71 are formed at positions corresponding to the claw portions 51 (see FIG. 5A) of the protector 40. Each of the holding portions 71 protrudes toward the inside of the tail cover 60 in the inverted triangular shape as viewed in the cross section, and is formed so as to hold the claw portion 51 of the protector 40 that has the triangular shape (see FIG. 10) in a cross section and prevent it from coming off. Incidentally, the detailed shape of the holding portion 71 will be described later. The outer edge portion 68 of the tail cover 60 is only in contact with the rear peripheral wall portion 56 of the protector 40, thereby preventing the tail cover 60 from coming into contact with the muffler 30.

Figure 8:
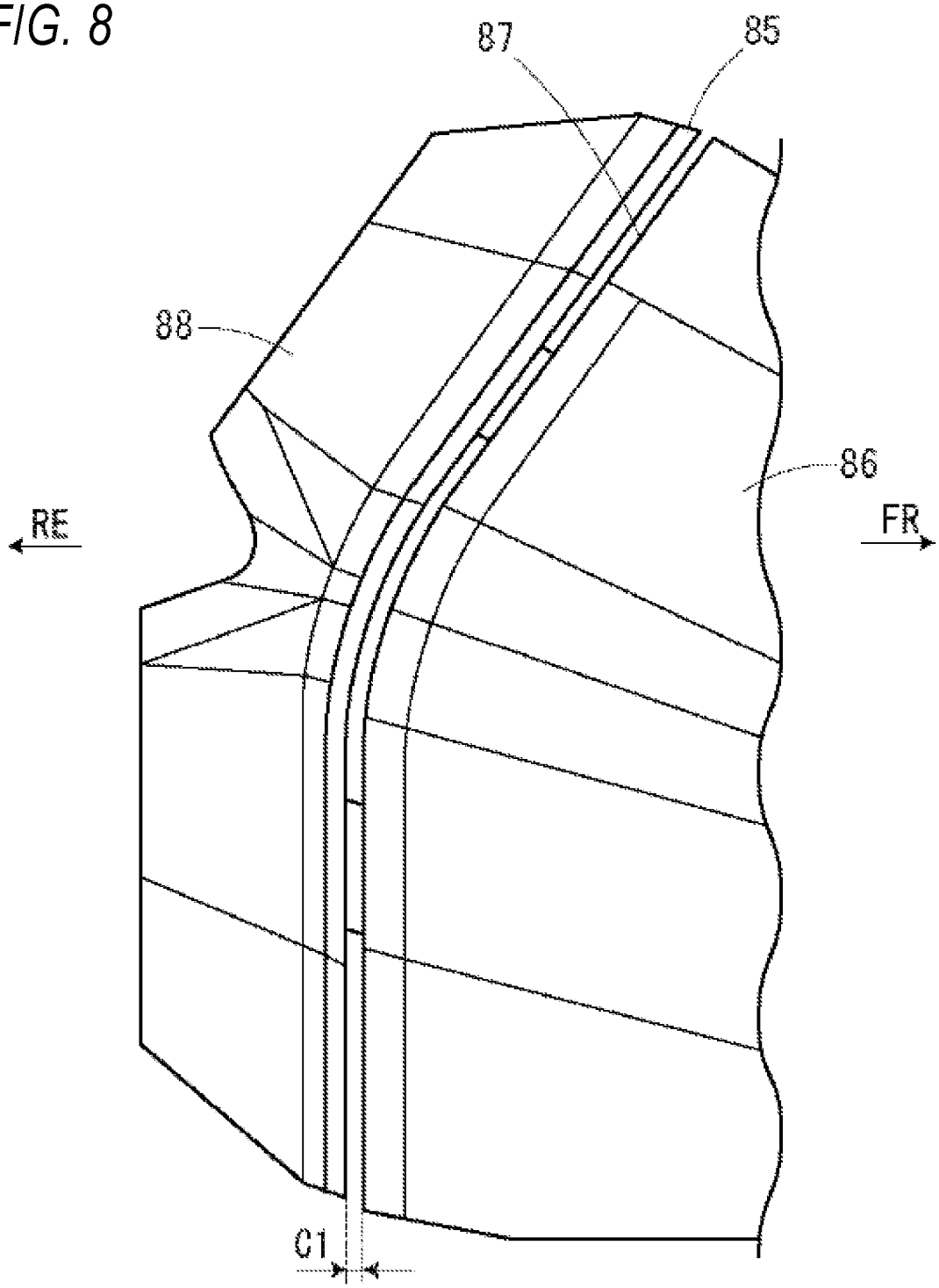
FIG. 8 is a right side view of a rear portion of an exhaust device of the comparative example.
Figure 9A:
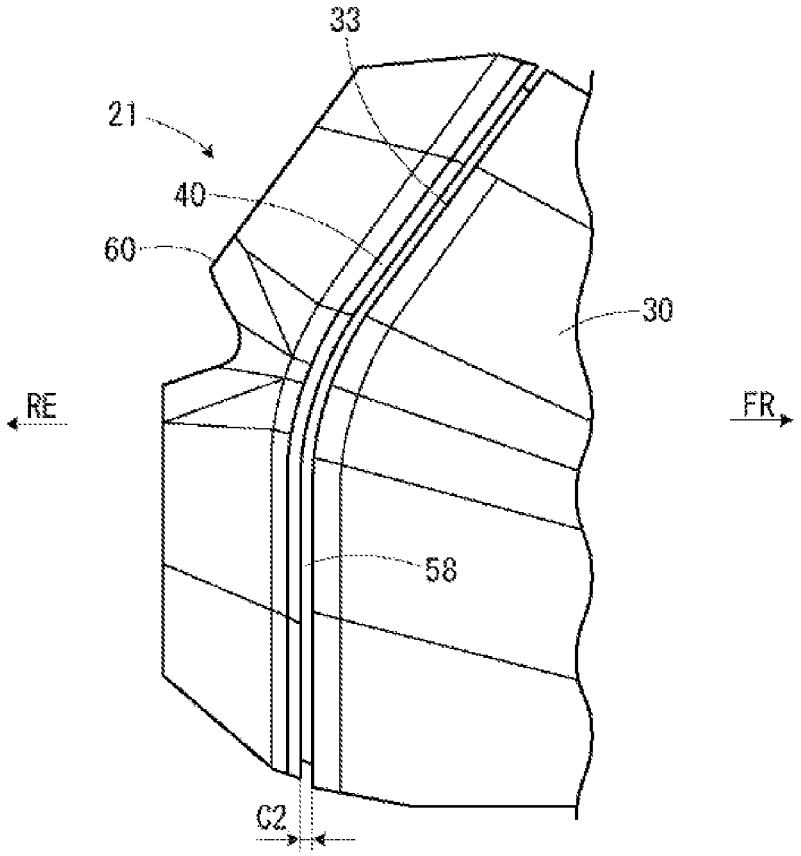
FIG. 9A is a right side view of a rear portion of the exhaust device of the embodiment.
Figure 9B:
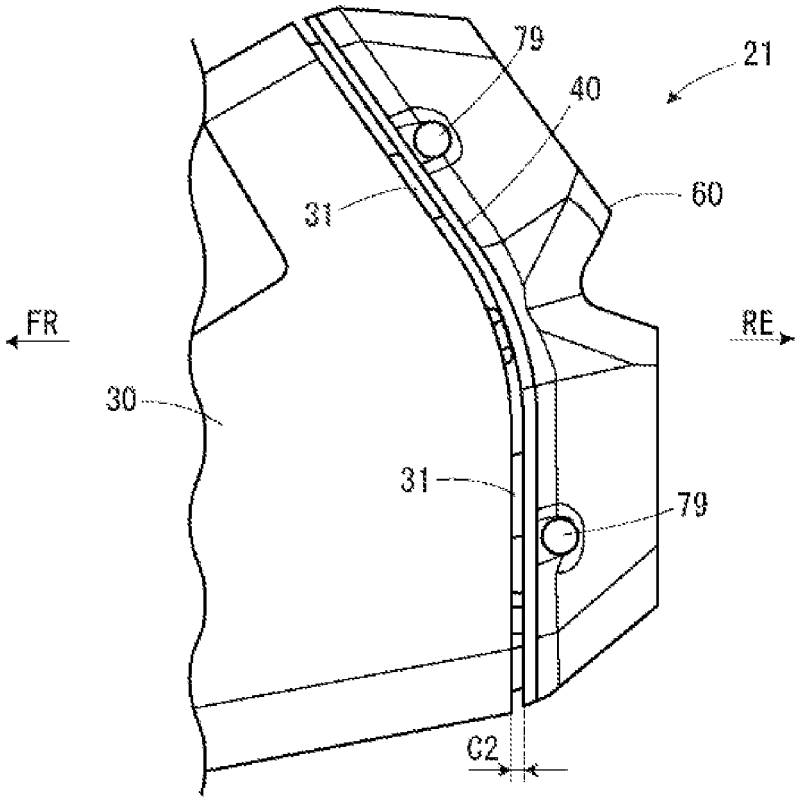
FIG. 9B is a left side view of the rear portion of the exhaust device of the embodiment.
Figure 10:
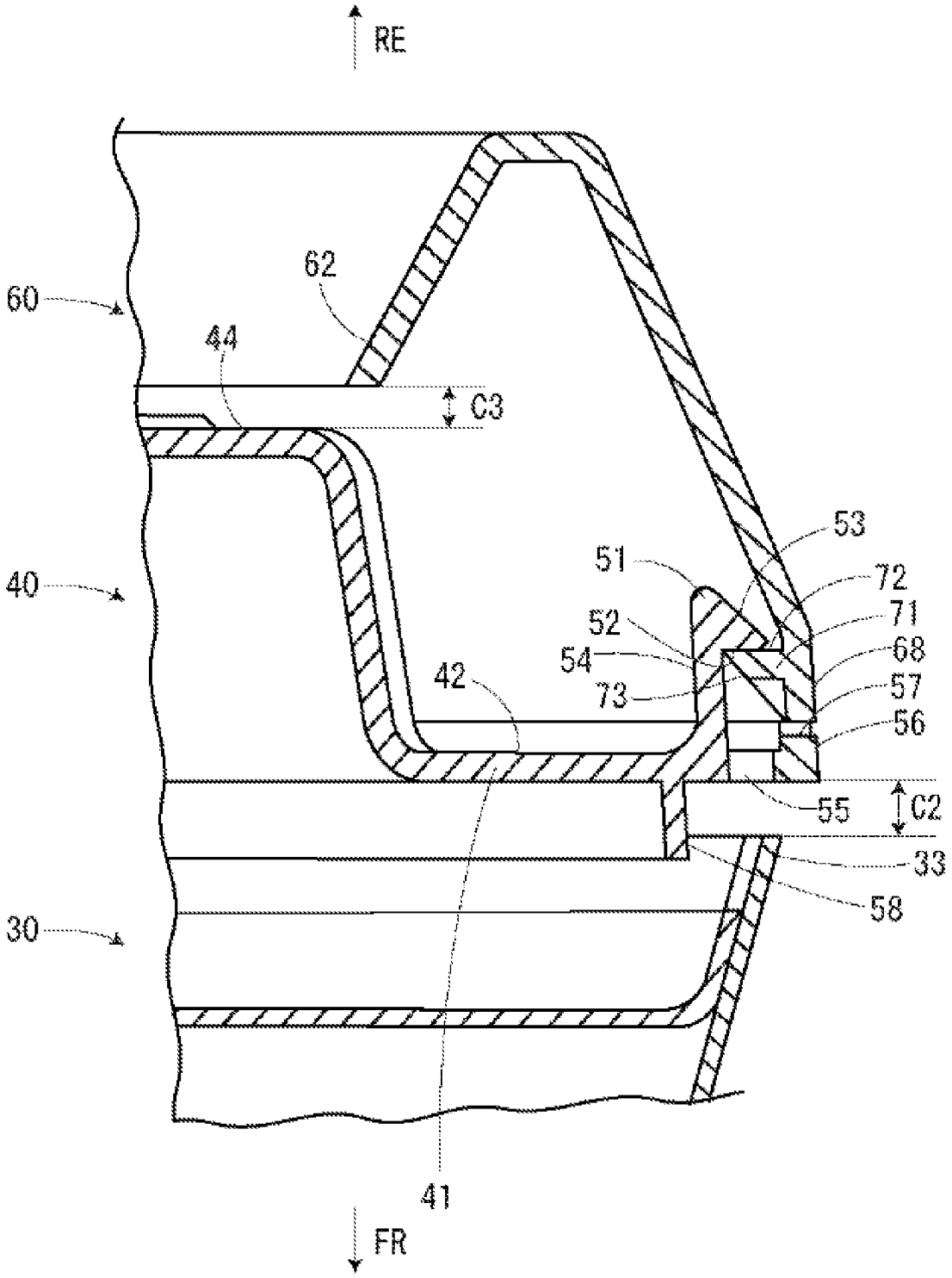
FIG. 10 is a partial sectional view of the exhaust device of the embodiment.

Next, an attachment state of the tail cover to the muffler will be described with reference to FIGS. 8 to 10. FIG. 8 is a right side view of a rear portion of an exhaust device of the comparative example. FIG. 9A is a right side view of a rear portion of the exhaust device of the present embodiment, and FIG. 9B is a left side view of the rear portion of the exhaust device of the present embodiment. FIG. 10 is a partial sectional view of the exhaust device of the present embodiment.

As shown in FIG. 8, the exhaust device of the comparative example is different from the exhaust device of the present embodiment in that a front peripheral wall portion is not formed on a protector 85. As described above, the protector 85 is fixed to the bracket (not shown) of a muffler 86. The protector 85 is separated from an outer edge portion 87 of the muffler 86 by the bracket so that heat of the muffler 86 is discharged to the outside. For this reason, a gap C1 is formed between the protector 85 and the muffler 86, and appearance of the exhaust device is impaired due to the conspicuous gap C1. In this way, in order to discharge the heat of the muffler 86, the gap C1 is formed so as to be conspicuous from the outside.

On the other hand, as shown in FIG. 9A, in the exhaust device 21 of the present embodiment, the front peripheral wall portion 58 that fills the gap C2 between the muffler 30 and the protector 40 is formed on the protector 40. Since the outer edge portion 33 of the muffler 30 and the front peripheral wall portion 58 of the protector 40 overlap with each other as viewed from the side of the vehicle, the gap C2 between the muffler 30 and the protector 40 is hidden by the front peripheral wall portion 58. Although there is the gap C2 between the muffler 30 and the protector 40, the front peripheral wall portion 58 makes the gap C2 between the muffler 30 and the protector 40 inconspicuous from the outside. Therefore, the appearance of the exhaust device 21 is not impaired by the gap C2 between the muffler 30 and the protector 40.

The front peripheral wall portion 58 is formed excluding the inner side of the protector 40 in the vehicle width direction, and as shown in FIG. 9B, the gap C2 between the muffler 30 and the protector 40 is not hidden by the front peripheral wall portion 58 on the inner side in the vehicle width direction. Since the gap C2 on the inner side in the vehicle width direction, which is the blind spot area, is inconspicuous, even if the gap C2 is not hidden by the front peripheral wall portion 58, the appearance of the exhaust device 21 is not impaired. In addition, an increase in weight and cost of the protector 40 is suppressed by an amount that the front peripheral wall portion 58 is not formed on the inner side of the protector 40 in the vehicle width direction. Further, hot air from the muffler 30 can be released to the outside through the gap C2 on the inner side in the vehicle width direction.

As described above, the inner sides of the protector 40 and the tail cover 60 in the vehicle width direction are fixed by the bolts 79, and the outer sides of the protector 40 and the tail cover 60 in the vehicle width direction are fixed by the snap fits. Therefore, the bolt 79 on the inner side in the vehicle width direction that is the blind spot area is inconspicuous, and the bolt 79 is not used on the outer side in the vehicle width direction that is the exposed area, so that the appearance of the exhaust device 21 is not impaired. In addition, the cost can be reduced by reducing the number of bolts 79 used, and further burden on the worker can be reduced and the assembly property can be improved by reducing the number of fastening portions of the bolts 79.

As shown in FIG. 10, on the outer sides of the protector 40 and the tail cover 60 in the vehicle width direction, the claw portion 51 formed on the protector 40 is held by the holding portion 71 formed on the tail cover 60. The claw portion 51 of the protector 40 is formed in the triangular shape as viewed in the cross section by a flat surface 52 parallel to the rear surface 42 of the plate-like portion 41 and an inclined surface 53 going outward of the plate-like portion 41 as it approaches the rear surface 42 of the plate-like portion 41. The holding portion 71 of the tail cover 60 is formed in the inverted triangular shape in the cross section by a flat surface 72 parallel to the rear surface 42 of the plate-like portion 41 and a reverse inclined surface 73 going inward of the tail cover 60 as it moves away from the rear surface 42 of the plate-like portion 41.

Therefore, by pressing the tail cover 60 against the protector 40, the claw portion 51 of the protector 40 is held by the holding portion 71 of the tail cover 60 using elastic deformation of the elastic arm 54 on a base end side of the claw portion 51. That is, when the inclined surface 53 of the claw portion 51 and the reverse inclined surface 73 of the holding portion 71 abut against each other, the elastic arm 54 is bent and the claw portion 51 is pushed inward by the holding portion 71. Further, when the outer edge portion 68 of the tail cover 60 abuts against the rear peripheral wall portion 56 of the protector 40, the pushing of the claw portion 51 by the holding portion 71 is released and the elastic arm 54 returns. Accordingly, the flat surface 52 of the claw portion 51 is locked to the flat surface 72 of the holding portion 71.

The recessed portion 57 is formed on the rear peripheral wall 56 of the protector 40 at the position facing the elastic arm 54. The through hole is formed on the mating surface of the rear peripheral wall portion 56 of the protector 40 and the outer edge portion 68 of the tail cover 60 by the recessed portion 57. By inserting the tip end of the tool such as a flathead screwdriver into the through hole and pushing the elastic arm 54 with the tip end of the tool, a locking state of the claw portion 51 and the holding portion 71 is released. The through hole on the mating surface of the protector 40 and the tail cover 60 functions not only as a working hole when the tail cover 60 is removed from the protector 40 but also as the heat discharge hole for releasing the hot air from the muffler 30 to the outside.

The through hole 55 is formed in the plate-like portion 41 of the protector 40 at a position facing the flat surface 52 of the claw portion 51. The through hole 55 is formed in order to prevent the claw portion 51 from being undercut as described above, but the through hole 55 also functions as the heat discharge hole for releasing the hot air from the muffler 30 to the outside. The outer edge portion 33 of the muffler 30 and the front peripheral wall portion 58 of the protector 40 face each other with an gap therebetween. Therefore, the outer edge portion 33 of the muffler 30 does not come into contact with the front peripheral wall portion 58 of the protector 40, and the heat transferred from the muffler 30 to the protector 40 can be reduced. That is, the protector 40 is not in direct contact with the muffler 30.

There is the gap C2 between the protector 40 and the muffler 30, and the hot air from the muffler 30 can be released to the outside through the gap C2. Further, there is a gap C3 between the inner edge portion 62 of the tail cover 60 and the bulging portion 44 of the protector 40, and the hot air in the tail cover 60 can be released to the outside through the gap C3. As described above, contact between the muffler 30, the protector 40, and the tail cover 60 is minimized, and the hot air from the muffler 30 is released to the outside through various through-holes or gaps. Therefore, heat damage to the tail cover 60 is effectively suppressed, and the resin material having the low heat resistance temperature can be used for the tail cover 60.

Figure 11:
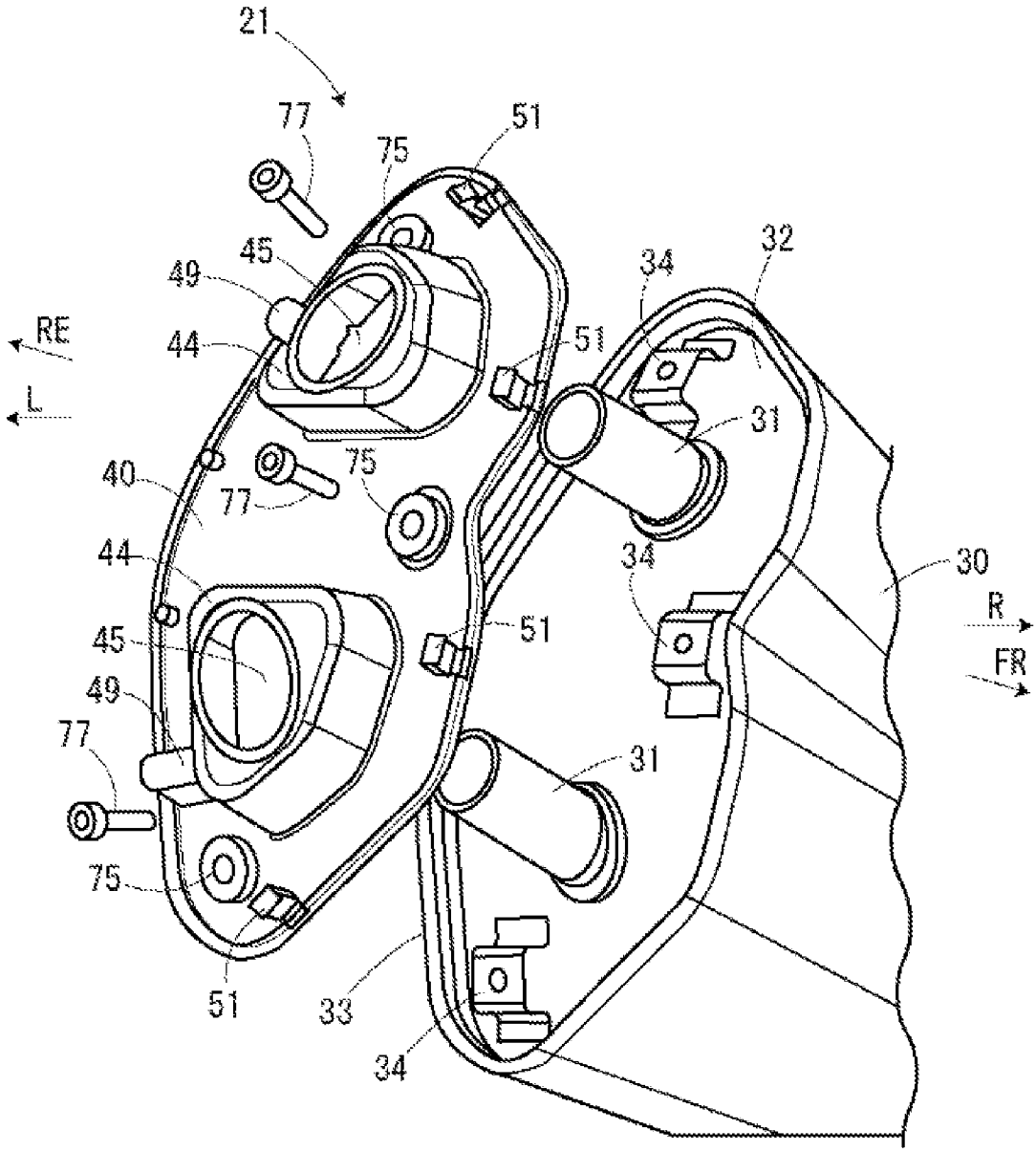
FIG. 11 is an explanatory view of an attachment work of the protector to the muffler of the embodiment.
Figure 12:
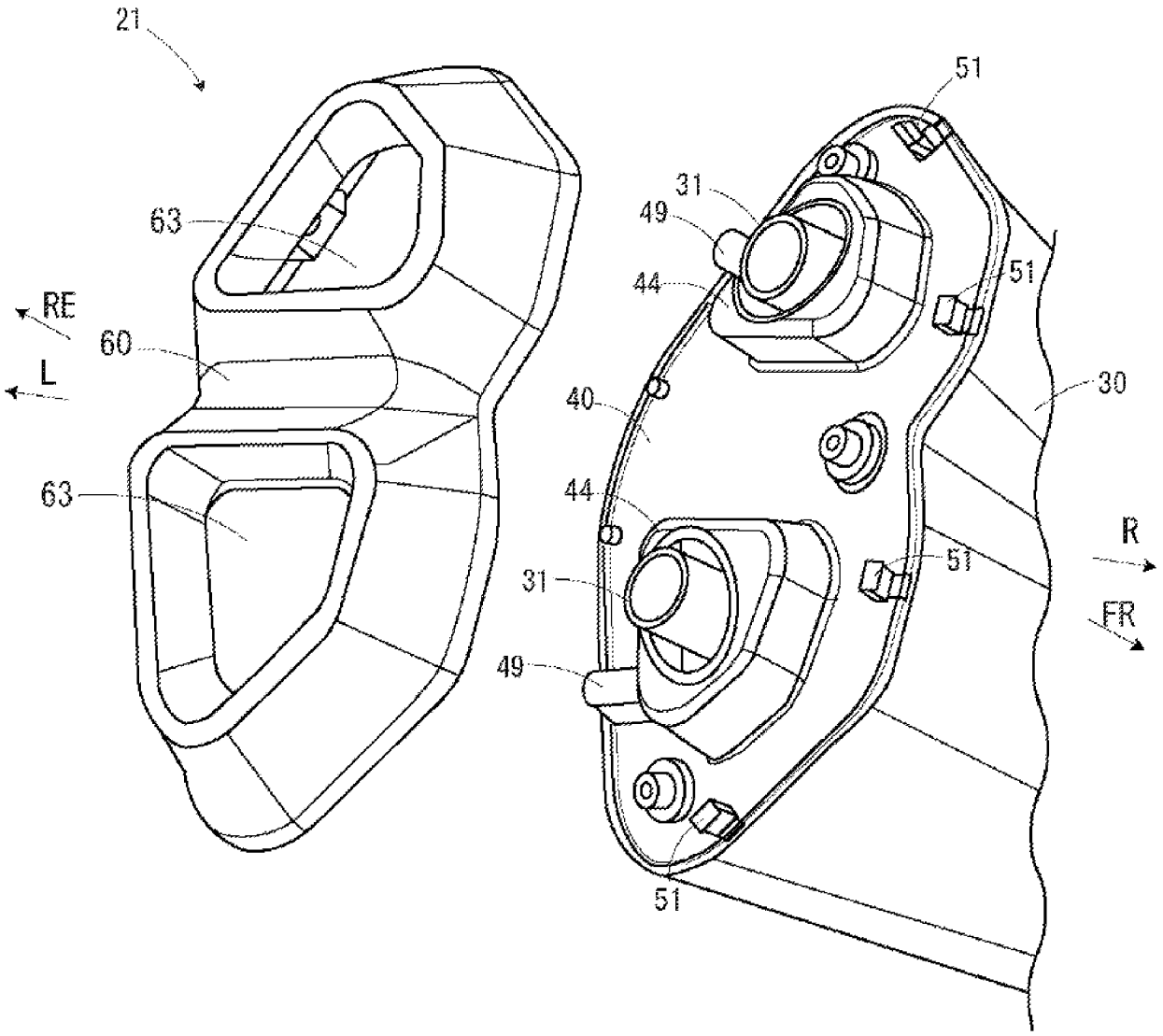
FIG. 12 is an explanatory view of an attachment work of the tail cover to the protector of the embodiment.

Next, an attachment work of the tail cover to the muffler will be described with reference to FIGS. 11 and 12. FIG. 11 is an explanatory view of an attachment work of the protector to the muffler of the present embodiment. FIG. 12 is an explanatory view of an attachment work of the tail cover to the protector of the present embodiment.

As shown in FIG. 11, cushion members 75 are respectively mounted to the openings 45 (see FIG. 5A) of the protector 40. The cushion member 75 is aligned with the bracket 34 on the rear surface 32 of the muffler 30. The cushion member 75 is so-called H-rubber, and has an opening at a center thereof. The cushion member 75 of the protector 40 is pressed against the bracket 34 of the muffler 30 by passing the tail pipe 31 of the muffler 30 through the opening 45 of the bulging portion 44 of the protector 40. In this state, the bolt 77 is inserted into the cushion member 75 via a washer (not shown), and the bolt 77 is screwed to the bracket 34, so that the protector 40 is fixed to the muffler 30.

At this time, only the rear end portion of the tail pipe 31 protrudes from the bulging portion 44 of the protector 40. In addition, the front peripheral wall portion 58 (see FIG. 10) of the protector 40 is accommodated inside the outer edge portion 33 of the muffler 30, and the gap C2 (see FIG. 10) between the muffler 30 and the protector 40 is hidden from a side by the front peripheral wall portion 58. Since the protector 40 is fixed to the bracket 34 via the cushion member 75, the bolt 77 is prevented from loosening due to the vibration of the muffler 30. In addition, since the protector 40 is fixed to the bracket 34 through the cushion member 75 made of the rubber, the heat transferred from the muffler 30 to the protector 40 is suppressed.

As shown in FIG. 12, when the protector 40 is fixed to the muffler 30, the tail cover 60 is aligned with the protector 40. The tail pipe 31 of the muffler 30 is passed through the opening 63 of the tail cover 60, and the tail cover 60 is pressed against the protector 40. As a result, the four claw portions 51 of the protector 40 are held by the four holding portions 71 of the tail cover 60 (see FIG. 10), and the outer sides of the protector 40 and the tail cover 60 in the vehicle width direction are fixed. In addition, the pair of fastening holes 67 (see FIG. 7A) of the tail cover 60 are aligned with the pair of boss portions 49 of the protector 40, and the bolts 79 (see FIG. 9B) are screwed to the screw holes of the boss portions 49 through the fastening holes 67, so that the inner sides of the protector 40 and the tail cover 60 in the vehicle width direction are fixed.

As described above, exposed sides of the protector 40 and the tail cover 60 are fixed by the snap fits, and blind spot sides of the protector 40 and the tail cover 60 are fixed by the bolts 79. Therefore, the bolt 79 is not conspicuous, and the appearance of the exhaust device 21 is prevented from being impaired. In addition, since the tail cover 60 is fixed to the muffler 30 via the protector 40, the heat transferred from the muffler 30 to the tail cover 60 is reduced. Therefore, although the tail cover 60 is formed of the resin material having the low heat resistant temperature, the resin material has the high moldability and can be plated, so that the design property of the tail cover 60 can be improved.

As described above, according to the present embodiment, the inner sides of the tail cover 60 and the protector 40 in the vehicle width direction are fixed by the bolt 79, and the outer sides of the tail cover 60 and the protector 40 in the vehicle width direction are fixed by elastic locking of the claw portion 51 and the holding portion 71. Since the bolt 79 on the inner side in the vehicle width direction is inconspicuous and the bolt 79 is not used on the outer side in the vehicle width direction, the appearance of the exhaust device 21 is prevented from being impaired. In addition, by reducing the number of the fastening portions of the bolts 79, the burden on the worker can be reduced, and the assembly property can be improved.

In the present embodiment, the holding portion 71 is formed on the outer side of the tail cover 60 in the vehicle width direction, and the claw portion 51 is formed on the outer side of the protector 40 in the vehicle width direction, but the present invention is not limited thereto. The claw portion 51 may be formed on the outer side of one of the protector 40 and the tail cover 60 in the vehicle width direction, and the holding portion 71 may be formed on the outer side of another of the protector 40 and the tail cover 60 in the vehicle width direction. For example, a claw portion may be formed on the outer side of the tail cover 60 in the vehicle width direction, and a holding portion may be formed on the outer side of the protector 40 in the vehicle width direction.

In the present embodiment, an elastic locking portion is formed by the elastic arm 54 and the claw portion 51, but the present invention is not limited thereto. The elastic locking portion may be any configured as long as the protector 40 and the tail cover 60 can be elastically locked.

In the present embodiment, a configuration is limited in which the protector 40 and the tail cover 60 are formed of the resin material, but the present invention is not limited thereto. The protector 40 may be formed of any material as long as the material has a higher heat resistance temperature and lower thermal conductivity than the tail cover 60.

In the present embodiment, the front peripheral wall portion 58 of the protector 40 is formed along the inner peripheral surface of the outer edge portion 33 of the muffler 30 excluding the inner side in the vehicle width direction, but the present invention is not limited thereto. The front peripheral wall portion 58 of the protector 40 may be formed along the entire circumference of the inner peripheral surface of the outer edge portion 33 of the muffler 30.

In the present embodiment, the protector 40 is fastened to the tail cover 60 by the bolt 79 as the fastening member, but the present invention is not limited thereto. The fastening member may be any member as long as the member can fasten the tail cover 60 to the protector 40, and may be a rivet, for example.

In the present embodiment, the through hole 55 is formed in the protector 40 in order to prevent the claw portion 51 from being undercut when the protector 40 is formed by the mold, but the present invention is not limited thereto. When the protector 40 is formed by the mold, the through hole 55 may not be formed in the protector 40 using the slide mold 83 or the like.

In the present embodiment, the recessed portion 57 is formed on the rear peripheral wall portion 56 of the protector 40, but the present invention is not limited thereto. The recessed portion 57 may be formed on at least one of the protector 40 and the outer edge portion 68 of the tail cover 60 as long as it is formed on the mating surfaces of the protector 40 and the outer edge portion 68 of the tail cover 60. For example, the recessed portion may be formed on the outer edge portion 68 of the tail cover 60, or the recessed portion may be formed in both the rear peripheral wall portion 56 of the protector 40 and the outer edge portion 68 of the tail cover 60. In the present embodiment, the pair of upper and lower tail pipes 31 protrude from the muffler 30, but the present invention is not limited thereto. A single tail pipe 31 may protrude from the muffler 30. In this case, the tail cover 60 may be formed in any manner as long as it covers a periphery of the single tail pipe 31.

The exhaust device 21 of the present embodiment can be appropriately applied to other vehicles on which the muffler 30 is disposed.

According to the present embodiment as described above, an exhaust device (21) in which a muffler is disposed on a side of a straddle-type vehicle (motorcycle 1), the exhaust device including: the muffler (30) including a tail pipe (31) configured to discharge exhaust gas and protruding rearward; a tail cover (60) covering a periphery of the tail pipe behind the muffler; and a protector (40) for heat shield interposed between the muffler and the tail cover, wherein inner sides of the tail cover and the protector in a vehicle width direction are configured to be fixed to each other by a fastening member (bolt 79), and wherein an elastic locking portion (claw portion 51) is formed on an outer side of one of the tail cover and the protector in the vehicle width direction, and a holding portion (71) holding the elastic locking portion is formed on an outer side of another of the tail cover and the protector in the vehicle width direction. According to this configuration, the inner sides of the tail cover and the protector in the vehicle width direction are fixed by the fastening member, and the outer sides of the tail cover and the protector in the vehicle width direction are fixed by elastic locking of the elastic locking portion and the holding portion. Since the fastening member on the inner side in the vehicle width direction is inconspicuous, and the fastening member is not used on the outer side in the vehicle width direction, appearance of the exhaust device is prevented from being impaired. In addition, by reducing the number of fastening positions of the fastening members, burden on a worker can be reduced, and an assembly property can be improved.

The exhaust device according to the present embodiment, wherein an outer edge portion (33) of the muffler extends rearward of the vehicle from a rear surface (32) of the muffler, and a peripheral wall portion (front peripheral wall portion 58) protrudes from a front surface (43) of the protector along an inner peripheral surface of the outer edge portion of the muffler, and wherein the outer edge portion of the muffler and the peripheral wall portion of the protector overlap as viewed from a side of the vehicle. According to this configuration, since the outer edge portion of the muffler overlaps with the peripheral wall portion of the protector, a gap (C2) between the muffler and the protector is hidden by the peripheral wall portion. The appearance of the exhaust device is not impaired by the gap between the muffler and the protector.

The exhaust device according to the present embodiment, wherein the outer edge portion of the muffler and the peripheral wall portion of the protector face each other with a gap therebetween. According to this configuration, since there is the gap between the outer edge portion of the muffler and the peripheral wall portion of the protector, heat transferred from the muffler to the tail cover can be reduced via the protector, and heat damage to the tail cover can be suppressed.

The exhaust device according to the present embodiment, wherein the peripheral wall portion of the protector is formed along the outer edge portion of the muffler excluding an inner side of the muffler in the vehicle width direction. According to this configuration, since the gap between the muffler and the protector on the inner side in the vehicle width direction is inconspicuous, the appearance of the exhaust device is not impaired even if the gap is not hidden by the peripheral wall portion. In addition, an increase in weight and cost of the protector is suppressed by an amount that the front peripheral wall portion is not formed on the inner side of the protector in the vehicle width direction. Further, hot air from the muffler can be released to the outside through the gap on the inner side in the vehicle width direction.

The exhaust device according to the present embodiment, wherein the elastic locking portion is formed on the protector, and the holding portion is formed on the tail cover. According to this configuration, the tail cover can be fixed to the protector by holding the elastic locking portion of the protector on the holding portion of the tail cover.

The exhaust device according to the present embodiment, wherein the elastic locking portion includes an elastic arm (54) erected on a rear surface of the protector and a claw portion (51) formed at a tip end of the elastic arm. According to this configuration, the tail cover can be fixed to the protector by a snap fit between the claw portion at the tip end of the elastic arm and the holding portion.

The exhaust device according to the present embodiment, wherein the protector is formed with a through hole (55) on a projection surface obtained by projecting the claw portion onto the rear surface (42) of the protector. According to this configuration, the claw portion is prevented from being undercut when the protector is released from a mold. Therefore, a structure of the mold can be simplified, and the cost can be reduced. In addition, the hot air from the muffler can be released to the outside through the through hole.

The exhaust device according to the present embodiment, wherein at least one of mating surfaces of the protector and an outer edge portion of the tail cover is formed with a recessed portion (57) at a position facing the elastic arm. According to this configuration, a through hole into which a tool can be inserted is formed in the mating surfaces of the protector and the tail cover by the recessed portion on the mating surfaces of the protector and the tail cover. By inserting the tool into the through hole and pushing the elastic arm, the elastic locking of the claw portion and the holding portion can be released. In addition, the hot air from the muffler can be released to the outside through the recessed portion.

The exhaust device according to the present embodiment, wherein the tail cover is formed of an acrylonitrile butadiene styrene (ABS) resin, and the protector is formed of a nylon resin. According to this configuration, by forming the protector with the nylon resin having high heat resistance, the tail cover can be formed with the ABS resin having low heat resistance. Since the ABS resin has high moldability and can be plated, a design property of the exhaust device can be improved.

A straddle-type vehicle according to the present embodiment including: the exhaust device described above. According to this configuration, it is possible to reduce work burden when the exhaust device is assembled and improve the design property of the straddle-type vehicle.

Although the present embodiment has been described, as another embodiment, a power source of the motorcycle is an engine, but an electric motor may be used as the power source. In addition, the above embodiments and modifications may be combined in whole or in part.

The technique of the present invention is not limited to the above embodiments, and various changes, substitutions, and modifications may be made without departing from the spirit of the technical idea. Further, the present invention may be implemented by using other methods as long as the technical idea of the present invention can be realized by the methods through progress of the technique or other derivative technology. Accordingly, claims cover all embodiments that may be included within the scope of the technical ideas.

According to the exhaust device of the aspect of the present invention, the inner sides of the tail cover and the protector in the vehicle width direction are fixed by the fastening member, and the outer sides of the tail cover and the protector in the vehicle width direction are fixed by elastic locking of the elastic locking portion and the holding portion. Since the fastening member on the inner side in the vehicle width direction is inconspicuous, and the fastening member is not used on the outer side in the vehicle width direction, appearance of the exhaust device is prevented from being impaired. In addition, by reducing the number of fastening positions of the fastening members, burden on a worker can be reduced, and an assembly property can be improved.

What is claimed is:

1. An exhaust device in which a muffler is disposed on a side of a straddle-type vehicle, the exhaust device comprising:

the muffler including a tail pipe configured to discharge exhaust gas and protruding rearward;

a tail cover covering a periphery of the tail pipe behind the muffler; and a protector for heat shield interposed between the muffler and the tail cover, wherein inner sides of the tail cover and the protector in a vehicle width direction are configured to be fixed to each other by a fastening member, and an elastic locking portion is formed on an outer side of one of the tail cover and the protector in the vehicle width direction, and a holding portion configured to hold the elastic locking portion is formed on an outer side of another of the tail cover and the protector in the vehicle width direction.

2. The exhaust device according to claim 1, wherein an outer edge portion of the muffler extends rearward of the vehicle from a rear surface of the muffler, a peripheral wall portion protrudes from a front surface of the protector along an inner peripheral surface of the outer edge portion of the muffler, and the outer edge portion of the muffler and the peripheral wall portion of the protector overlap as viewed from a side of the vehicle.

3. The exhaust device according to claim 2, wherein the outer edge portion of the muffler and the peripheral wall portion of the protector face each other with a gap therebetween.

4. The exhaust device according to claim 2, wherein the peripheral wall portion of the protector is formed along the outer edge portion of the muffler excluding an inner side of the muffler in the vehicle width direction.

5. The exhaust device according to claim 1, wherein the elastic locking portion is formed on the protector, and the holding portion is formed on the tail cover.

6. The exhaust device according to claim 5, wherein the elastic locking portion includes an elastic arm erected on a rear surface of the protector and a claw portion formed at a tip end of the elastic arm.

7. The exhaust device according to claim 6, wherein the protector is formed with a through hole on a projection surface obtained by projecting the claw portion onto the rear surface of the protector.

8. The exhaust device according to claim 6, wherein at least one of mating surfaces of outer edge portions of the protector and the tail cover is formed with a recessed portion at a position facing the elastic arm.

9. The exhaust device according to claim 1, wherein the tail cover is formed of an acrylonitrile butadiene styrene (ABS) resin, and the protector is formed of a nylon resin.

10. A straddle-type vehicle comprising:

the exhaust device according to claim 1.

* * * * *